US005094349A

United States Patent [19]

DeVito

[11] Patent Number: 5,094,349

[45] Date of Patent: Mar. 10, 1992

[54] DISPLAY MODULE FOR FLEXIBLE SHEETS

[76] Inventor: John P. DeVito, 5817 N. Ottawa, Chicago, Ill. 60631

[21] Appl. No.: 672,027

[22] Filed: Mar. 19, 1991

[51] Int. Cl.[5] ..... A47F 5/00

[52] U.S. Cl. ..... 211/50; 211/88

[58] Field of Search ..... 211/50, 10, 51, 88, 211/126; D7/631; 206/215

[56] References Cited

U.S. PATENT DOCUMENTS

| | | | |
|---|---|---|---|
| 2,656,933 | 10/1953 | Pierie | 211/88 |
| 2,705,564 | 4/1955 | Bray | 211/51 |
| 3,878,966 | 4/1975 | Haboush | 211/50 X |
| 4,510,872 | 4/1985 | Parry | 211/50 X |
| 4,579,232 | 4/1986 | Fedak | 211/50 |
| 4,585,128 | 4/1986 | Hannecke | 211/50 X |
| 4,938,365 | 7/1990 | Conway et al. | 211/50 |

OTHER PUBLICATIONS

Popai News, vol. 15, No. 2, Apr./May 1991, pp. 25 and 29.

P/O/P Times, vol. 4, No. 4, May 1991, pp. 20, 22, 30, 54, 59.

Creative, vol. 23, No. 1, Mar.-Apr. 1991, pp. 8, 11, 27, 39, 41, 70, 90, 95, 99, 115, 147, 153, 157, 158, 159.

Creative World, Sep. 1990, pp. 18, 76, 101, 105, 108, 125, 127, 159, 161, 210.

Brochure Holders Inc. (1990) Taymar Brochure Holders—2 Pages.

Miscellaneous Beemak Brochures, 3 Pages.

*Primary Examiner*—Robert W. Gibson, Jr.

*Attorney, Agent, or Firm*—Wood, Phillips, Mason, Recktenwald & Van Santen

[57] ABSTRACT

A display and dispensing module for flexible sheets having an open topped container with a front, two sides, a back, and a bottom. The container sides are spaced apart a distance less than the width of the flexible sheets to be displayed therein, and the back includes curved sections connecting to the sides, where the curved sections are curved about substantially vertical axes. The module is formed from two molded plastic halves secured together, with one half including the front and portions of the sides and bottom, and the other half including the back, the curved sections, and the remaining portions of the sides and bottom, the sides being parallel to one another. A plurality of base sections are provided for side by side mounting of a selected number of modules, each base section being substantially equal in width to the width of an associated module. Each base section also has a groove for receiving the module bottom portion, tabs on the base section snappingly received in associated openings in the module to secure the module thereon, and male and female connectors on opposite sides of each base section for securing the base sections in side to side relation, where the module associated with one of the base sections blocks the male connector of an adjacent base section from separating from the female connector of the one base section.

16 Claims, 1 Drawing Sheet

Fig. 1
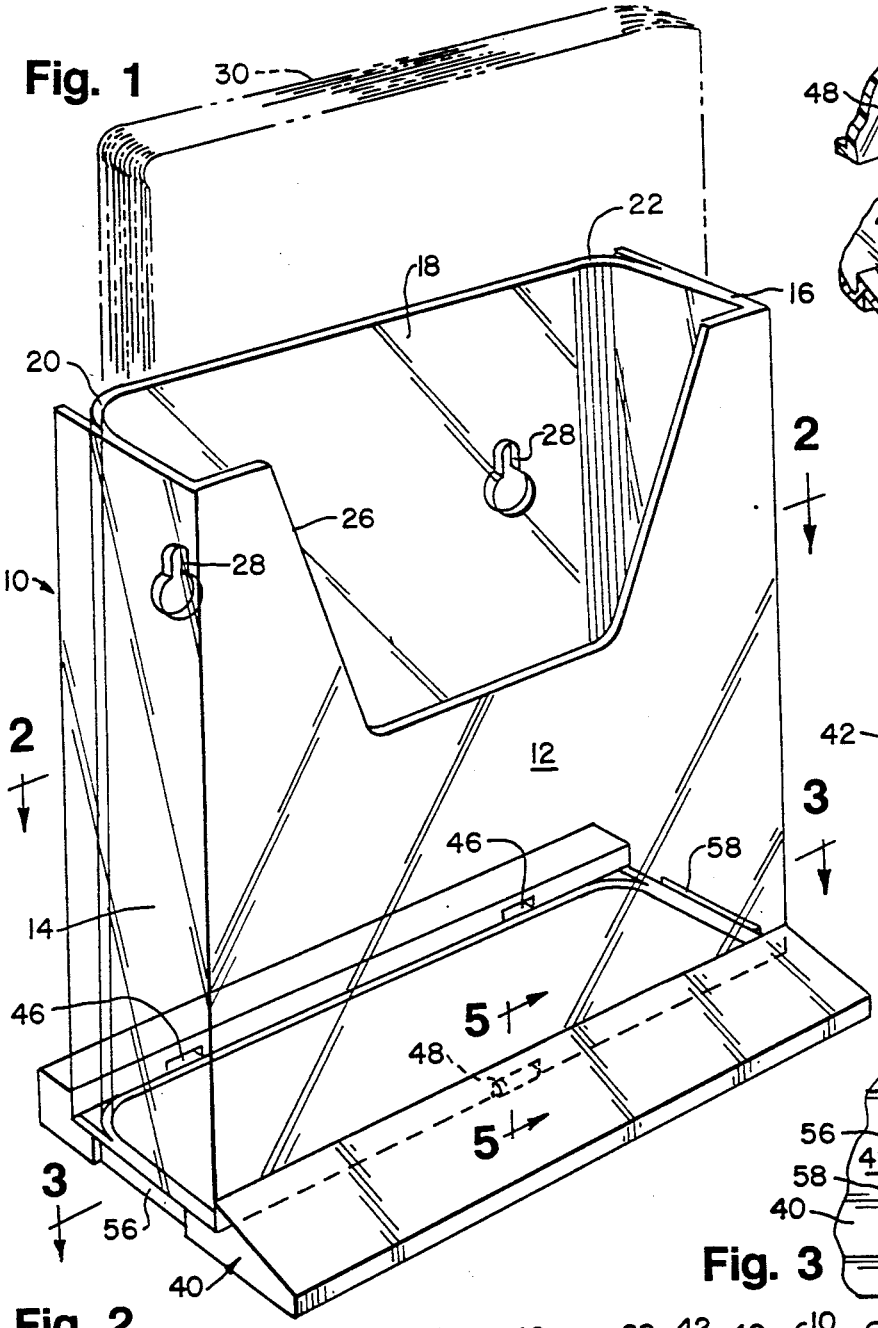
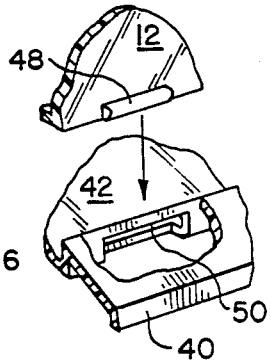
Fig. 4
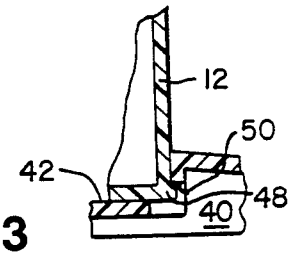
Fig. 5
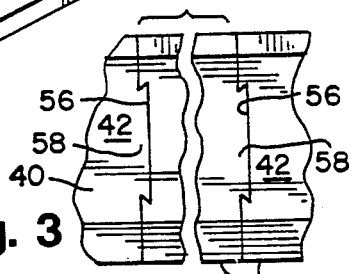
Fig. 3
Fig. 2
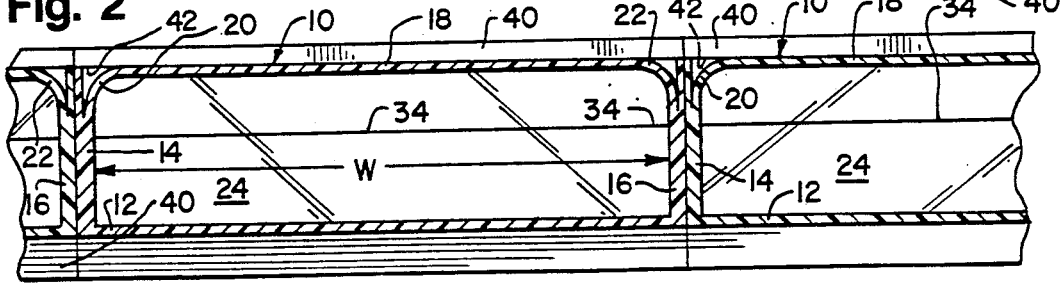

DISPLAY MODULE FOR FLEXIBLE SHEETS

BACKGROUND OF THE INVENTION

1. Technical Field

The present invention is directed toward a display stand, and more particularly toward display modules for brochures and the like.

2. Background Art

Display and dispensing modules for flexible sheets such as brochures and the like are known in the art. Typically, such modules are unitary transparent plastic pockets open on the top. A stack of brochures can be dropped into the pocket, and the brochures can then be observed from the front of the pocket and, when desired, an observer can reach into the pocket and remove a brochure for his own use.

Given the desired usage of such displays (particularly the removal of brochures from time to time), different numbers of brochures can typically be found in a pocket, including as little as one brochure. As a result, particularly for single sheet brochures made of lightweight paper, brochures which remain in the pocket for long periods of time have a tendency to slump (that is, they tend to develop a wavy configuration from bottom to top). Slump is extremely undesirable for brochures, as they can make the brochure difficult to read or recognize in the pocket (thereby failing to attract the attention of the observer), and also leave the brochures very unattractive and unprofessional appearing should an observer take one for his perusal or use. Wrinkling and distortion of a brochure can detract from its usual purpose—to attract the attention of a casual observer and impress the observer into inquiring further about the information provided therein.

Prior art modules for brochures have been adapted for display on an upright stand, as well as on longitudinally disposed base members for side by side display of different brochures. However, such modules have typically been formed in a molding process which requires that the modules have a draft angle between the sides in order to allow the module to be properly withdrawn from the mold. As a result, such prior art modules when used in side by side displays are required to have a tapered space between the sides of adjacent modules, which spacing not only itself detracts from the appearance of the display but also provides an area within which undesirable dirt and/or debris can accumulate. Of course, separation of the base members can also result in undesirable spacing between modules and a generally uneven and unattractive appearance.

The present invention is directed toward overcoming one or more of the problems set forth above.

SUMMARY OF THE INVENTION

In one aspect of the present invention, a display and dispensing module for flexible sheets is provided having an open topped container with a front, two sides, a back, and a bottom. The container sides are spaced apart a distance less than the width of the flexible sheets to be displayed therein. The back includes curved sections connecting to the sides, where the curved sections are curved about substantially vertical axes.

In another aspect of the present invention, the module is formed from two molded plastic halves secured together, with one half including the front and portions of the sides and bottom, and the other half including the back, the curved sections, and the remaining portions of the sides and bottom, the sides being parallel to one another.

In still another aspect of the present invention, a plurality of base sections are provided for side by side mounting of a selected number of modules. Each base section is substantially equal in width to the width of an associated module and has a groove for receiving the module bottom portion, tabs on the base section snappingly received in associated openings in the module to secure the module thereon, and male and female connectors on opposite sides of each base section for securing the base sections in side to side relation, where the module associated with one of the base sections blocks the male connector of an adjacent base section from separating from the female connector of the one base section.

It is an object of the invention to allow flexible sheets such as brochures to be vertically displayed without slumping of the sheets.

It is another object of the invention to provide an aesthetically pleasing side by side display for a plurality of different flexible sheets. It is still another object of the invention to provide a secure side by side display of any selected plurality of different flexible sheets.

BRIEF DESCRIPTION OF THE DRAWINGS

FIG. 1 is a perspective view of a display module and base section embodying the present invention;

FIG. 2 is a cross-sectional view taken along line 2—2 of FIG. 1, and showing a portion of adjacent modules;

FIG. 3 is a broken view of interconnected base sections;

FIG. 4 is an exploded, broken, partial cross-sectional view showing a tab and slot connection for a module and base section; and FIG. 5 is a broken cross-sectional view taken along line 5—5 of FIG. 1 showing the tab and slot connection of a module and base section.

DESCRIPTION OF THE PREFERRED EMBODIMENT

A display and dispensing module 10 embodying the present invention is shown in FIG. 1. Generally, the module 10 includes a front wall 12, side walls 14, 16, and a back wall 18, all formed of a suitable molded plastic material. Further, curved sections 20, 22 (curved about substantially vertical axes) connect the back wall 18 to the side walls 14, 16.

A bottom 24 is also provided on the module 10. Openings (not shown) can also be provided in the bottom 24 if desired to prevent dirt and/or moisture from accumulating in the module by allowing the dirt and moisture to escape through those openings.

The front wall 12 includes a cutout 26, which serves both to provide maximum visual display for the materials displayed in the module 10 and to allow an observer to easily reach into the module 10 to remove a brochure when so desired.

The back wall 18 includes slots 28 which allow the module 10 to be hung from projecting screws or the like on display stands, as is known in the art. Further, double strip adhesive pads could be provided to hang the module 10 on many surfaces, particularly where screws are undesirable (for example, a refrigerator).

The interior of the module 10 has a width W (see FIG. 2) which is less than the width of the brochures or other papers to be displayed in the module 10. For example, where typical 8½ inch wide brochures are to be displayed, an interior width W of approximately 8⅜ inches has been found to be suitable. As a result of this configuration, the displayed brochures (a portion of a stack of which is shown in phantom in FIG. 1 and indicated by reference number 30) are slightly curved about a vertical axis. This forced curvature of the brochures 30 significantly improves the strength of the brochures 30 to effectively prevent any undesirable slumping of the brochures under the force of gravity. Therefore, the brochures 30 are displayed with an essentially controlled and even curvature which will not detract from the appearance of the brochures 30, and all undesirable uneven, wavy slumping of the brochures 30 will be prevented. In short, the module 10 having this improved configuration will ensure ideal display of brochures over long periods of time.

Preferably, the module 10 is also manufactured by molding two halves of suitable transparent plastic material, the two halves being divided generally along the dividing line 34 shown in FIG. 2. The module 10 is then assembled by securing the two halves together in abutting relation by some suitable means, such as by sonic welding.

By forming the modules 10 in this manner, the side walls 14, 16 may be precisely molded parallel to one another, without even a slight draft angle therebetween as required in the prior art unitary modules. As a result, when multiple modules 10 are displayed side by side (as shown in FIG. 2 and as discussed further below), the side walls 14, 16 of adjacent modules 10 will abut along their entire height, thereby providing not only an aesthetically pleasing appearance but also eliminating any gaps within which dirt or debris might otherwise be caught.

Base members 40 are also disclosed for both securing each module 10 against tipping when used on countertop displays or the like, as well as to ensure that multiple such modules 10 are maintained together in an aesthetically pleasing straight arrangement without gaps therebetween which might otherwise trap dirt or debris.

Each base member 40 is preferably made of a strong plastic materially. Further, each base member 40 is formed with essentially the same width W as the associated modules 10, and includes a groove 42 therein which is as wide as the module 10 is deep.

A suitable tab and slot arrangement is also provided to secure the module 10 in the groove 42 of its associated base member 40. For example, as shown in FIGS. 1, 4 and 5, the module 10 can be formed with projecting tabs 46, 48 on the back wall 18 and front wall 12, and openings 50 can be provided in the sides of the base member groove 42. The module 10 can thus be secured to the base member 40 by taking advantage of elastic deformation of the base member 40 by pushing the module 10 into the groove 42 and thereby snapping it into place.

Of course, other suitable tab and slot arrangements could also be used within the scope of this invention, including, for example, tabs projecting from the base member into slots in the module and/or one or more hooked tabs projecting from the bottom of the groove into a slot in the module bottom.

As best shown in FIG. 3, the base member 40 includes a female recess 56 on one side and a male connector 58 on the other side. The male connector 58 is tapered outwardly and the female recess 56 is similarly shaped so that adjacent base members 40 so connected cannot be pulled apart my longitudinal forces applied to the assembly. Assembly of adjacent base members 40 is thus accomplished by sliding the male connector 58 down into the female recess 56 (or vice versa).

As a result of this configuration, when adjacent base members 40 are so assembled and modules 10 then snapped into place in their associated base members 40, the modules 40 are secured in a side by side arrangement with no gaps between modules 10 as previously discussed. Further, since the modules 10 prevent the male connectors 58 from sliding up out of the female recess 56 to which they are mounted, the entire assembly is reliably secured together in a virtually perfect, seemingly unitary, linear arrangement of multiple modules 10. As a result, not only are the modules 10 initially secured in such a desirable arrangement, but that arrangement will be reliably maintained should anyone thereafter accidentally or intentionally move one of the modules.

As should be apparent to a skilled artisan who has acquired an understanding of the invention disclosed herein, use of modules 10 and associated base members 40 will provide a number of desirable characteristics which are crucial to the purpose of any display. For example, modules 10 made according to the present invention will ensure that brochures 30 or the like displayed therein will not undesirably slump, even if only a few are displayed over a long period of time. Further, by use of this invention, an aesthetically pleasing side by side display for a plurality of different brochures 30 is reliably provided, without gaps between the modules 10 (which can be unattractive in its own right in addition to accumulating dirt and other debris) and without concern that the modules be undesirably misaligned or separated as a result of jarring or the like over time.

Still other aspects, objects, and advantages of the present invention can be obtained from a study of the specification, the drawings, and the appended claims.

What is claimed is:

1. A display and dispensing module, comprising:

flexible sheets displayed in and dispensed from the module, said sheets having a selected width; and an open topped container having a front, two sides, a back, and a bottom, wherein said sides are spaced apart a distance less than the selected width of the flexible sheets displayed therein, and said back includes curved sections connecting to said sides.

2. The module of claim 1, wherein said curved sections are curved about substantially vertical axes.

3. The module of claim 1, wherein each of said curved sections is substantially tangential to said back and said connected side.

4. The module of claim 1, wherein said front is substantially transparent.

5. A display and dispensing module for flexible sheets, comprising an open topped container having a front, two sides, a back, and a bottom, wherein said sides are spaced apart a distance less than the width of the flexible sheets to be displayed therein, and said back includes curved sections connecting to said sides;

wherein said module is formed from two molded plastic halves secured together, one half including the front and portions of the sides and bottom, and the other half including the back, the curved sections, and the remaining portions of the sides and bottom; and wherein the sides are parallel.

6. The display module of claim 5, wherein each of said curved sections is substantially tangential to said back and said connected side.

7. A display for a plurality of different flexible sheets, comprising:

a plurality of open topped modules each having a front, two sides, a back, and a bottom, wherein said sides are spaced apart a distance less than the width of the flexible sheets to be displayed therein, and said back includes curved sections connecting to said sides; and a plurality of base sections, each base section being substantially equal in width to the width of an associated module and having a groove therein for receiving said module bottom, means for mating an associated one of said modules in said base section groove, and male and female means on opposite sides of each base section for securing said base sections in side to side relation, said male securing means being slidably received in said female securing means.

8. The display of claim 7, wherein the module associated with one of the base sections blocks the male securing means of an adjacent base section from slidably separating from the female securing means of the one base section.

9. The display of claim 7, wherein said curved sections are curved about substantially vertical axes.

10. The display of claim 7, wherein each of said curved sections is substantially tangential to said back and said connected side.

11. The display of claim 7, wherein said front is substantially transparent.

12. The display of claim 7, wherein said module is formed from two molded plastic halves secured together, one half including the front and portions of the sides and bottom, and the other half including the back, the curved sections, and the remaining portions of the sides and bottom;

wherein the sides are parallel.

13. The display of claim 7, wherein the mating means comprises a pair of tabs on said base section snappingly received in associated openings in the back of the associated display module, and a front base section tab spaced from the module back and snappingly received in a front opening in the module.

14. A display for flexible sheets, comprising:

a module formed of a pair of molded transparent plastic halves, one of said halves including a front wall substantially perpendicular to a first side wall portion, a second side wall portion, and a bottom portion, said side wall portions being parallel to one another and spaced apart a distance less than the width of the flexible sheets, and said bottom portion being substantially perpendicular both of said side wall portions, the other of said halves including a back wall, the remaining portion of the bottom portion, and transitional sections on opposite sides of the back wall and curved about substantially vertical axes, said other half being secured to the one half with said transitional sections and remaining bottom portion being mated in abutting relation with the side wall portions and bottom portion, respectively, of the one half.

15. The display of claim 14, wherein the curved sections define interior curved sections which are substantially tangential to the back wall and the side wall portions.

16. The display of claim 14, further comprising:

a plurality of said modules; and a plurality of base sections, each base section being substantially equal in width to the width of an associated module and having a groove therein for receiving said module bottom portion, a pair of tabs on said base section snappingly received in associated openings in the back wall of the display module, a front tab spaced from the module back and snappingly received in a front opening in the module, and male and female means on opposite sides of each base section for securing said base sections in side to side relation, said male securing means being slidably received in said female securing means;

wherein the module associated with one of the base sections blocks the male securing means of an adjacent base section from slidably separating from the female securing means of the one base section.

* * * * *